US006523927B2

(12) United States Patent
Asai et al.

(10) Patent No.: US 6,523,927 B2
(45) Date of Patent: Feb. 25, 2003

(54) METHOD AND APPARATUS FOR PROCESSING RECORDING MEDIA HAVING EMBEDDED INFORMATION

(75) Inventors: Naoki Asai, Nagano (JP); Kunio Omura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/987,435

(22) Filed: Nov. 14, 2001

(65) Prior Publication Data

US 2002/0067386 A1 Jun. 6, 2002

Related U.S. Application Data

(63) Continuation-in-part of application No. 09/130,165, filed on Aug. 6, 1998.

(30) Foreign Application Priority Data

Aug. 16, 1997 (JP) ..... 9-12259

(51) Int. Cl.[7] ..... B41J 29/393; B41J 29/38; B41J 2/165

(52) U.S. Cl. ..... 347/19; 347/14; 347/23

(58) Field of Search ..... 347/1–19, 23, 347/22, 30, 101, 104, 105, 14; 400/568, 621, 625, 637.1

(56) References Cited

U.S. PATENT DOCUMENTS 4,027,142 A 5/1977 Paup et al.
4,786,789 A 11/1988 Gaucher
5,049,898 A * 9/1991 Arthur et al. ..... 347/19
5,831,644 A * 11/1998 Kato ..... 347/22
5,833,380 A 11/1998 Hosomi et al.
6,017,161 A 1/2000 Harris et al.
6,118,469 A 9/2000 Hosomi

FOREIGN PATENT DOCUMENTS

| | | |
|---|---|---|
| EP | 0 115 189 | 8/1984 |
| EP | 0 441 964 | 8/1991 |
| EP | 0 492 900 | 7/1992 |
| EP | 0 677 392 | 10/1995 |
| JP | 3-036054 | 2/1991 |
| JP | 3-224760 | 10/1991 |
| JP | 3-297670 | 12/1991 |

* cited by examiner

*Primary Examiner*—Raquel Yvette Gordon
*Assistant Examiner*—Charles W Steward, Jr.
(74) *Attorney, Agent, or Firm*—Nixon & Vanderhye P.C.

(57) ABSTRACT

An apparatus includes a passage along which a recording medium with magnetic information recorded thereon can travel and an information read head disposed along the passage for reading the magnetic information. The apparatus also includes a first print head disposed on the first side of the passage and a second print head disposed on the second side of the passage. The first print head prints information on a first surface of the recording media based on data obtained by the information read head and the second print head prints information on a second surface of the recording media based on the data obtained by the information read head. Methods of processing a recording medium with magnetic information recorded thereon also are disclosed.

9 Claims, 9 Drawing Sheets

METHOD AND APPARATUS FOR PROCESSING RECORDING MEDIA HAVING EMBEDDED INFORMATION

This application is a continuation-in-part application of Ser. No. 09/130,165, filed Aug. 6, 1998, which claims the benefit of Japanese Patent Application No. JP Hei. 9-212259, filed August 6, 1997, which are incorporated herein by reference in their entirety.

BACKGROUND OF THE INVENTION

The present invention relates generally to methods and apparatus for reading embedded information such as magnetic ink characters recorded on a recording medium and printing information on the recording medium.

Checks such as personal checks are widely used in business transactions and for personal shopping. Generally, an amount of money and a signature are inscribed on the front surface of the check. Such an inscription can be referred to as a "front surface inscription". In addition, specified information such as the number of a bank, an individual bank account number, the number of the check and the like are inscribed on the check using magnetic ink characters.

Conventionally, the owner of the check writes the front surface inscription on the check. However, in recent years, it has become popular to execute the front surface inscription using a printer.

The presence of magnetic ink on a check can be detected, for example, by a magnetic head using magnetic ink character recognition (MICR) techniques. Thus, magnetic ink character readers which can read magnetic ink characters inscribed on a check have been developed and are currently used, for example, in retail stores. Upon receiving a check, store personnel can operate such a reader to detect the magnetic ink, read the items inscribed on the check, and confirm the validity of the check. The operator then uses a printer to print items to be endorsed on the checks, such as a certification, the name of a store which has received the check, and the like.

When the reading of the MICR characters and printing of the endorsement and front surface inscription are executed by separate devices, a relatively long time is required to execute all the necessary steps. Moreover, difficulties exist even in devices capable of reading the MICR characters and printing the endorsement and front surface inscription. For example, after printing the endorsement inscription, the check typically must be turned over and loaded into the printer again to execute the front surface inscription. Such techniques unnecessarily complicate and lengthen the overall process.

SUMMARY OF THE INVENTION

In general, according to one aspect, an apparatus for processing a recording media with embedded information such as recorded magnetic information includes a passage along which the recording media can travel and an information read head disposed along the passage for reading the recorded magnetic information. The apparatus also includes a first print head disposed on a first side of the passage and a second print head disposed on a second side of the passage. The first print head prints information on a first surface of the recording media based on data obtained by the information read head and the second print head prints information on a second surface of the recording media based on the data obtained by the information read head.

One or more of the following features are present in some implementations. The apparatus can include a first opening through which the recording media is inserted into the passage and a second opening through which the recording media can be discharged from the passage. The first print head can be located on the same side of the passage as the information read head and can be closer to the second opening than the second print head. The first opening can be substantially horizontal and located in a side of the apparatus, with the second opening located in the top of the apparatus.

In some implementations, the apparatus includes a first pair of rollers and a second pair of rollers for moving the recording media along the passage. The first pair of rollers can be located between the first opening and the second print head, and the second pair of rollers can be located between the first and second print heads.

The apparatus also can include a stopper which can be moved into the passage to prevent movement of the recording media along the passage. The stopper can be located at a position along the passage between the first and second pairs of rollers. Additionally, the apparatus can include a sensor for detecting the presence of the recording media at a specified position in the passage. The sensor can be located between the first pair of rollers and the stopper.

The apparatus further can have a controller for controlling the first print head to print information on the recording media while the recording media moves along the passage in a first direction and for controlling the second print head to print information on the recording media while the recording media moves along the passage in a second direction opposite the first direction. Alternatively, the controller can control the first and second print heads to print information on the recording media at substantially the same time, for example, as the recording media moves along the passage.

In yet other implementations, the second print head can include a removable print unit and a rotatable paper feed part can be provided for feeding paper past the print position of the first print head.

According to another aspect, a method of processing a recording media with recorded magnetic information includes feeding the recording media in a first direction along a passage and reading the magnetic information recorded on the recording media while moving the recording media along the passage in a second direction opposite the first direction. Information is printed on two opposite surfaces of the recording media based on data obtained during the reading step. The information can be printed while moving the recording media along the passage in the first direction. The method also includes discharging the recording media from the passage.

Information can be printed on the first surface using a first print head and information can be printed on the second surface using a second print head. The surfaces of the recording media can be printed at substantially the same time.

Additionally, feeding the recording media in a first direction can include moving the recording media to a specified location in the passage. Reading the magnetic information can be performed after the recording media reaches the specified location. The method also can include determining whether the recording media is valid based on reading the magnetic information.

Furthermore, discharging the recording media from the passage can include moving the recording media in the first direction.

In yet a further aspect, a method of processing a recording media with recored magnetic information includes reading the magnetic information while moving the recording media in a first direction along a passage. The method further includes printing information on a first surface of the recording media based on data obtained during the reading step. Printing information on the first surface is performed while the recording media travels in a second direction opposite the first direction. The method also includes printing information on a second surface of the recording media based on data obtained during the reading step. Printing information on the second surface is performed while the recording media travels in the first direction. The recording media then can be discharged from the passage.

According to some implementations of the latter method, the recording media is fed along the passage in the first direction to a specified position in the passage. The step of feeding can be performed after reading the magnetic information and before printing information on the first surface of the recording media. The method also can include determining whether the recording media is valid based on reading the magnetic information.

A first print head can be used to print information on the first surface of the recording media, and a second print head can be used to print information on the second surface of the recording media. The recording media can be moved in the first direction to discharge it from the passage.

In yet another aspect, a method for processing a recording medium with embedded information includes feeding the recording medium along a passage in a first direction toward a discharge opening and reading magnetic information recorded on the recording medium while moving the recording medium along the passage. After completion of the reading step, information is printed on a first surface of the recording medium while moving the recording medium along the passage. Further, after completion of the reading step, information is printed on a second surface of the recording medium opposed to the first surface while moving the recording medium along the passage. Hereupon, the feeding direction of the recording medium in the reading step is the first direction, the feeding directions of the recording medium in the first and second printing steps are respectively the first direction, and the information printings on the first and second surfaces are done substantially simultaneously or concurrently.

Various implementations include one or more of the following advantages. The first and second print heads can be used, respectively, to perform front surface inscription and back surface endorsement printing operations on opposite surfaces of a recording media such as a personal check. For example, the front surface inscription and the back surface endorsement printing operations can be performed after reading the MICR characters. Therefore, simply by loading a check into the apparatus once, all the necessary operations can be executed. The processing time can be reduced, and because it is not necessary to turn over the check S, the entire operation is simplified. Additionally, since the check S can be loaded so that the surface with the MICR characters recorded thereon faces up, the operator can set the check S while observing the front surface. That facilitates mounting of the check S in the apparatus.

Other features and advantages will be apparent from the following detailed description, the accompanying drawings and the claims.

DESCRIPTION OF THE PREFERRED EMBODIMENTS

Figure 1:
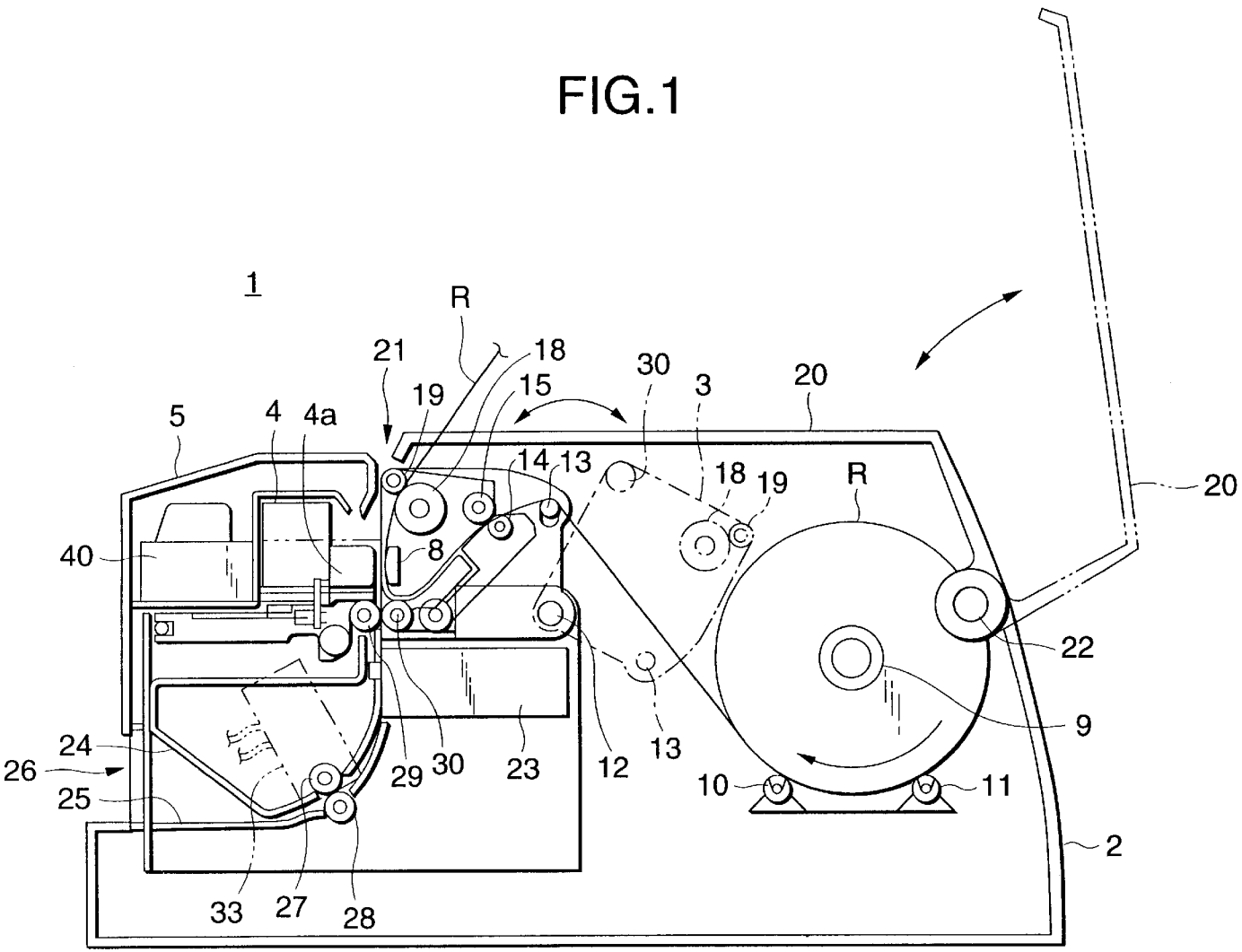
FIG. 1 is a schematic view of the internal structure of a composite processor according to the invention.
Figure 2:
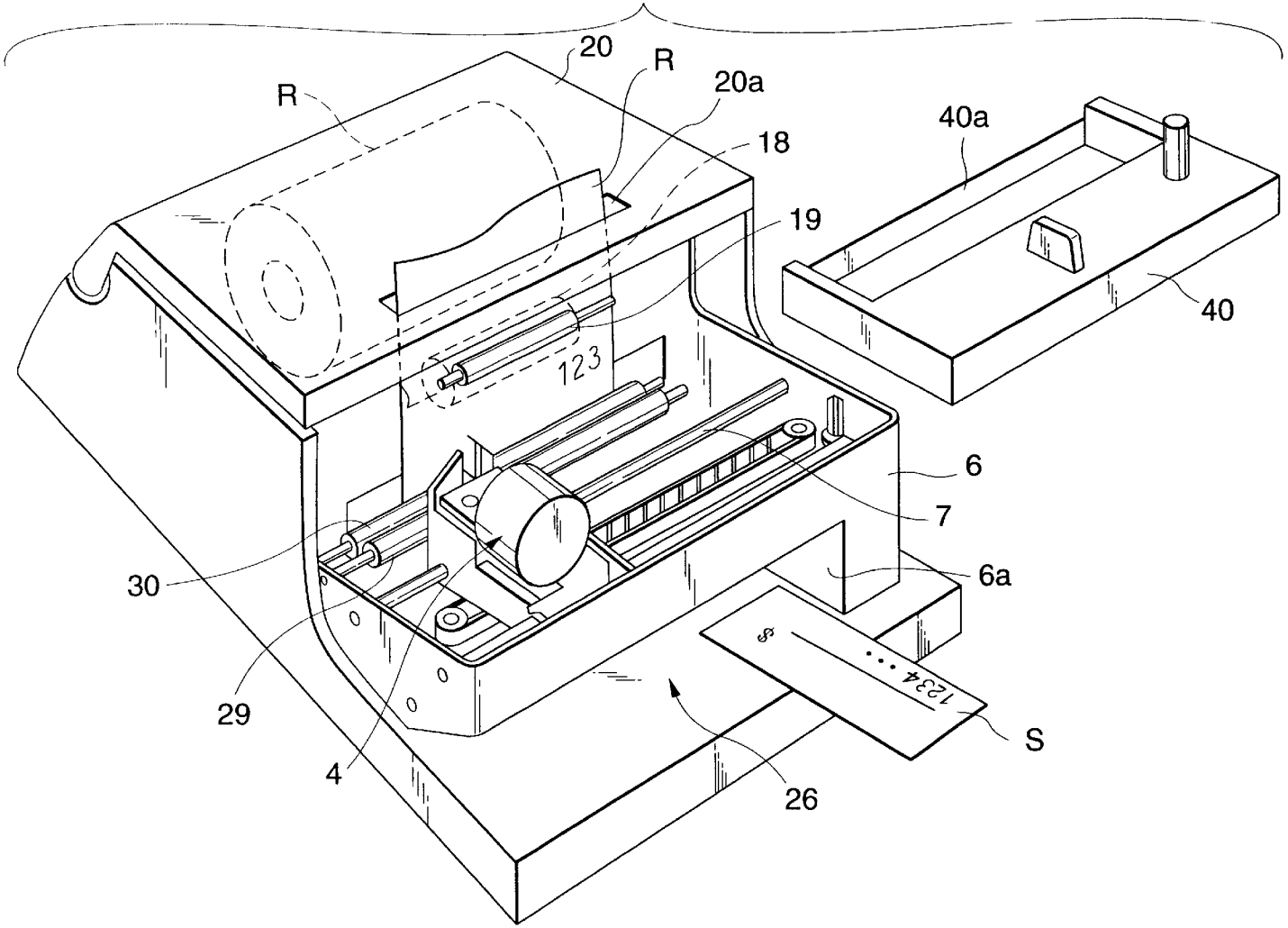
FIG. 2. is a perspective view of the interior portion of the composite processor of FIG. 1.
Figure 3:
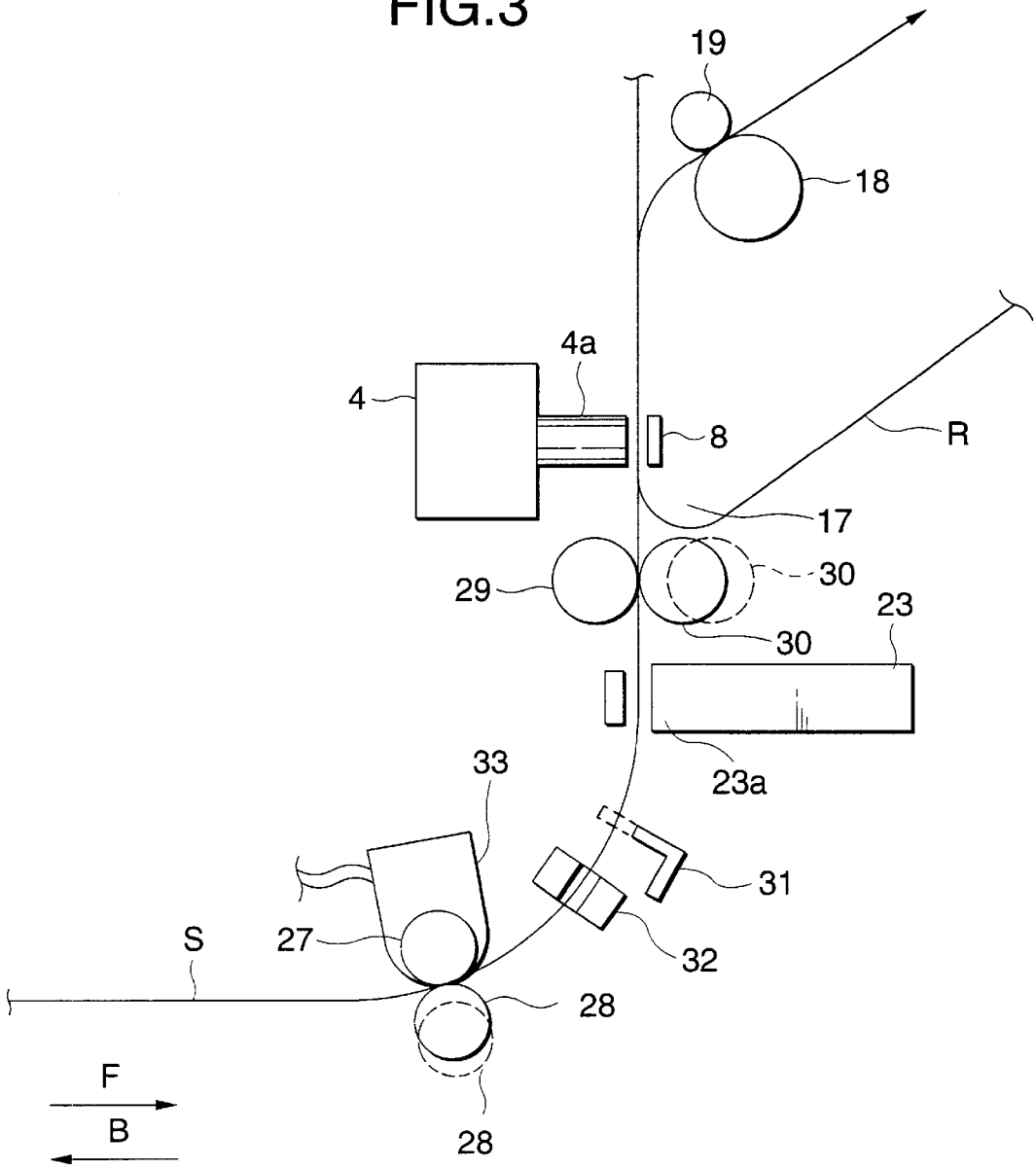
FIG. 3. is a partial schematic view of the composite processor.

Referring to FIGS. 1, 2 and 3, a composite processor 1 includes a roll of paper R disposed in the rear portion of a main body cover 2 formed of resin or the like. A roll paper feed mechanism 3 is located in front of the roll of paper R.

A first print part 4 is disposed in front of the roll paper feed mechanism 3 and is configured to perform a printing operation using, for example, an ink ribbon system. The first print part 4 is used to print information on a medium such as the roll paper R, a check S or another recording media. The first print part 4 is covered with a main body front cover 5 formed of resin or the like. The roll paper R, the roll paper feed mechanism 3 and the first print part 4 are mounted on a main body frame 6 which is formed of metal or other rigid materials.

The first print part 4 also is configured so that it can be moved freely between the two side portions of the main body frame 6 along a guide rail 7 mounted on the main body frame. A ribbon cassette 40 which carries an ink ribbon 40*a* is mounted on the main body frame 6. The first print part 4 is positioned so that a print head 4*a* is disposed opposite a platen 8 provided in the roll paper feed mechanism 3.

The roll paper R is rotatably supported by a pair of support rollers 10 and 11 which are arranged parallel to a core portion 9. The roll paper R also is configured so that the leading end of the roll paper R can be drawn upwardly out from the lower side of the main body cover 2.

The roll paper feed mechanism 3 can be rotated freely about a support shaft 12 so that it is removed from an operative position shown by the solid line in FIG. 1 to expose a second print part 23 explained in detail below. A feed passage for the roll paper R is formed in the roll paper feed mechanism 3. Specifically, the roll paper R is pulled in by a paper guide roller 13 which reduces a load caused by a rotational moment of the paper roll R, and paper feed rollers 14, 15 provided in the roll paper feed mechanism 3. While the roll paper R is guided in the upward direction by a guide portion 17 (FIG. 3), the roll paper R is moved between the print head 4*a* of the first print part 4 and the platen 8. The printed roll paper R is then discharged from an opening 20*a* formed in a main body upper cover 20 by a pair of feed rollers 18 and 19. The main body upper cover 20 is mounted so that it can be rotated freely about a support shaft 22.

A second print part 23 which is used, for example, to print an endorsement on the check S is disposed below the roll paper feed mechanism 3. The second print part 23 performs a printing operation using, for example, an ink ribbon system. In the illustrated embodiment, the second print part 23 includes an impact shuttle-type print head 23*a* and includes a print unit which can be mounted on and removed from the main body of the processor.

Note that the impact shuttle-type print head 23*a* comprises a shuttle unit having a plurality of impact dot elements disposed in a line parallel to the print line with a predetermined distance from each other, and prints a single dot line by moving the shuttle unit for the predetermined distance. Thus multiple line printing is performed by repeating the single dot line printing and paper feeding for one dot.

Since the shuttle print head 23*a* requires only one line of dot print elements, a compact and especially thin print head can be obtained. Moreover, because of the simple structure required for moving the shuttle unit, a cost effective small printer can be realized. The detailed structure of the shuttle print head is explained in the U.S. Pat. No. 4,373,438 which is incorporated herein by reference.

A feed passage for the check S is partially formed below the first print part 4. A recording media insertion opening 26 is defined by a pair of guide members 24 and 25 which extend up to the neighboring portion of the second print part 23. A pair of first feed rollers 27 and 28 are located on either side of the guide members 24 and 25. The feed passage for the check S also includes a second pair of feed rollers 29 and 30 which are disposed between the first and second print heads.

The first print part 4 is disposed on one side of the second feed rollers 29 and 30, and the second print part 23 is disposed on the other side of the second feed rollers 29 and 30. When printing the front surface inscription and endorsement on the check S, the respective print heads 4*a* and 23*a* of the first and second print parts 4 and 23 can be positioned at optimum print positions in consideration of the endorsement print position limited within a predetermined position. An opening 21 is provided above the second feed rollers 29 and 30 for discharging the check S in a substantially vertical direction. The opening 21 is defined by the main body upper cover 20 and main body front cover 5.

The check S can be fed along the passage, using the first feed rollers 27, 28 and the second feed rollers 29, 30, in a first (forward) direction, indicated generally by arrow F in FIG. 3, or in a second (reverse) direction, indicated generally by arrow B in FIG. 3. The feed rollers 27 and 29 are rotated in synchronization with each other by a drive mechanism (not shown).

The first feed rollers 27 and 28 are configured so that the lower feed roller 28 can be moved freely toward or away from the upper feed roller 27. Also, the feed roller 30 can be moved freely toward or away from the feed roller 29. Note that a known mechanism such as a plunger can be used for moving the feed roller 28 or 30 toward or away from the opposing feed roller.

A form stopper 31 (FIG. 3) is interposed between the first feed rollers 27, 28 and second rollers 29, 30 on the feed passage. The form stopper 31 is used to stop the inserted check S temporarily and can be moved away from the feed passage.

A sensor 32, which is used to detect the presence or absence of the check S, is disposed adjacent the form stopper. The sensor 32 can be a photo sensor such as a photo interrupter or photo reflector.

A magnetic head 33 is disposed adjacent the first feed rollers 27 and 28 and serves as an information read head to read MICR characters inscribed or recorded on the check S. The magnetic head 33 is configured such that, by pressing a pressure member (not shown) against the check S, the check S can be brought into close contact with the head portion of the MICR read head. A known roller or pad having a relatively low friction coefficient with checks S is used as the pressure member. The pressure member is configured to move away from the magnetic head making an enough gap for slip sheets to pass the magnetic head without abutting thereto. Known plungers are utilized for moving the pressure member.

Figure 6:
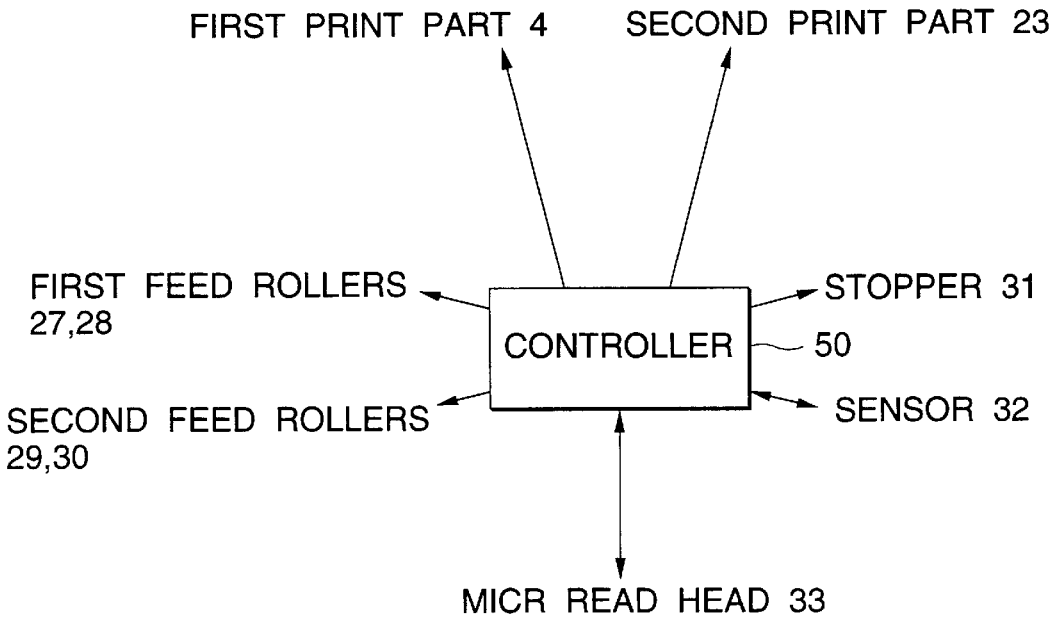
FIG. 6 shows a control system for the composite processor of FIG. 1.

The processor 1 also includes drivers (not shown) for driving the first print part 4, the second print part 23, the first feed rollers 27, 28 and the second feed rollers 29, 30, as well as the form stopper 31, the sensor 32 and the magnetic head 33. The drivers are connected through interfaces and buses (not shown) to a controller 50 (FIG. 6) which includes a central processing unit (CPU), a read only memory (ROM), and a random access memory (RAM). The controller recognizes and analyzes signals from the sensor 32 and the magnetic head 33. Based on the results, the controller controls the operations of the respective parts of the processor 1, including the various drivers.

The composite processor 1 is configured so that it can feed a regular size slip sheet and the like, as well as a check S, and allows printing operations to be performed on the slip sheet.

Figure 4:
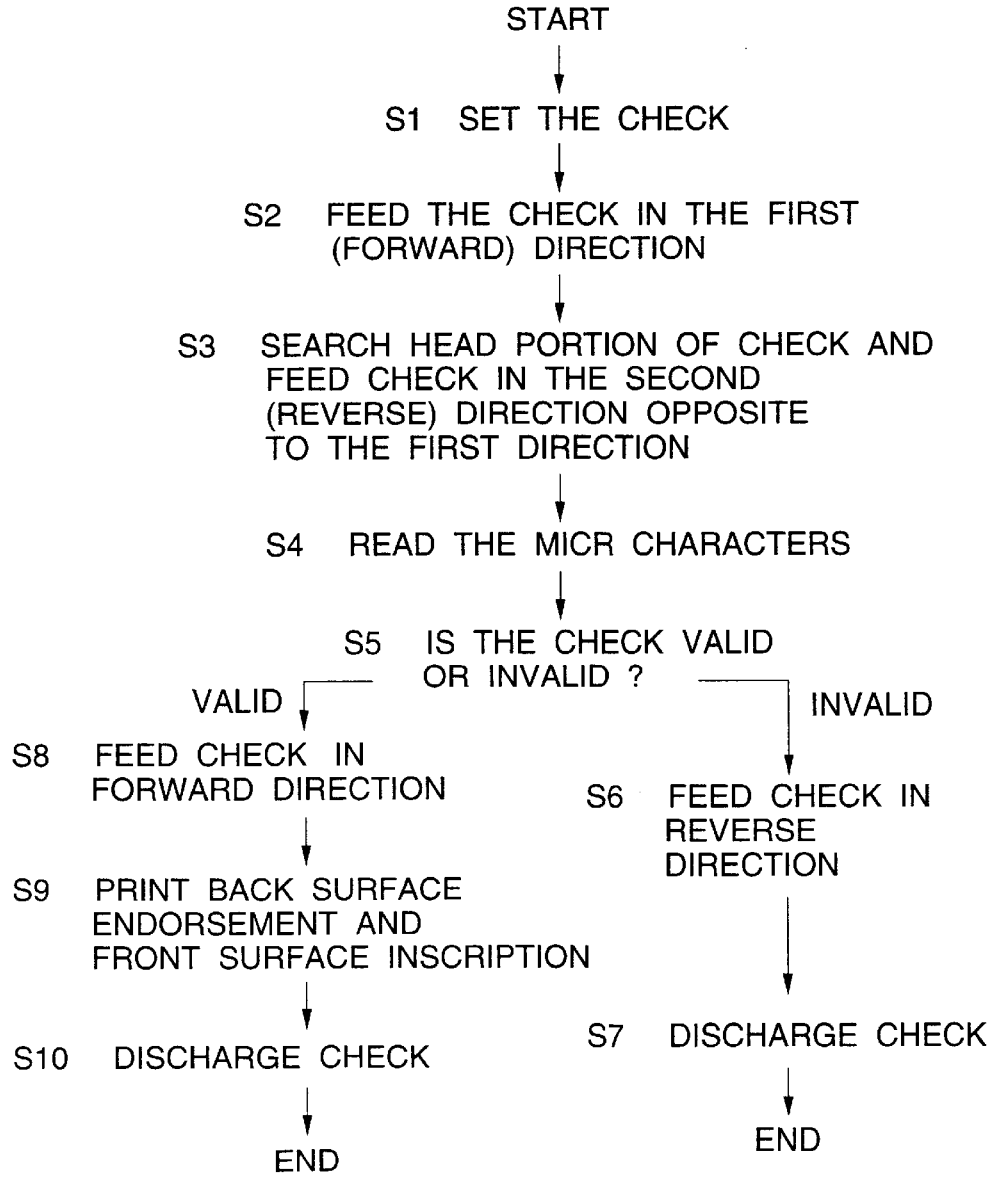
FIG. 4. is a flow chart of a method of controlling a composite processor according to one embodiment of the invention.

Referring to FIG. 4, the operation of the composite processor 1 according to a first embodiment is explained. As indicated by step S1, the processor 1 starts waiting the check S with moving the lower roller 28 to the position shown by the dotted lines in FIG. 3 to place the first rollers 27, 28 in an open state. At the same time, the form stopper 31 extends across the feed passage. As shown in FIG. 2, the check S is inserted through the opening 26 with the front surface of the check S facing up and the right side edge thereof abutting with a guide wall 6*a* of the main body frame 6. The leading edge of the check S thereby abuts against the form stopper 31, and the check S is positioned at a predetermined location in the feed passage defined by the form stopper 31 and the guide wall 6*a*. The predetermined position is a reference position of the check S based on which the following processes such as MICR reading and printing on the upper or reverse side are performed. When the sensor 32 detects the leading edge of the check S, the processor starts executing a process in step S2 assuming that the check S has been set accurately.

In step S2, the check S is fed in the forward direction by moving the lower feed roller 28 to the position indicated by the solid line in FIG. 3, thereby placing the first feed rollers 27, 28 in a closed state. At the same time, the form stopper 31 is moved away from the feed passage, and the first feed rollers 27, 28 are rotated to feed the check S in the forward direction.

In the processor of this embodiment, the form stopper 31 is used to define the reference position of the leading edge of the check S. The present invention is not limited to the structure. That is, in absence of the form stopper 31, the first feed rollers 27, 28 hold the check S when the sensor 32 detects the check S. And then the check S is fed backward to the position where the sensor 32 no more detects the check S. After then, the check S is fed forward gradually and stopped where the sensor 32 detects presence of the check S. Thus, the leading edge of the check S can be positioned at the sensor position, the reference position.

As indicated by step S3, when the check S arrives at a specified position where the trailing edge of the MICR character string inscribed on the check S has passed a detecting portion of the magnetic head 33, the feeding of the check S is stopped. Hereinafter, this process is referred as MICR character positioning.

In step S4, the first feed rollers 27, 28 are rotated to feed the check S in the reverse direction. While feeding the check S, the magnetic head 33 is driven to read the MICR characters recorded or inscribed on the front surface of the check S. The magnetic head 33 is driven to generate magnetic field to biasing magnetic field changes caused by the MICR character passing the magnetic head. After finishing MICR reading, the magnetic head stops generating bias magnetic field and the transportation of the check S is stopped.

In step S5, a determination is made, based on the data obtained from the MICR read head, as to whether the check S is valid or invalid. If the check S is judged to be invalid, then the processing moves to step S6. If, however, the check S is judged to be valid, then the processing moves to step S8. An inserted recording media may be judged invalid, for example, because it is inserted improperly, because a recording media other than a check S is inserted, or because the check S itself is invalid.

Note that this judgment can be made by a host device to which the processor of this embodiment is connected. That is, the processor sends to the host device the MICR reading results such as character codes and status data of the processor, the host device judges whether the check S is valid or not based on the results received from the processor, and the processor then receives the judgment made by the host device. Thus more accurate judgment can be made by executing more complicated processes such as making an inquiry to a bank which issues the check S.

If the inserted check S is determined to be invalid, then, as indicated by step S6, the check S is fed in the reverse direction. The check S is discharged from the insertion opening 26, as indicated by step S7. Although these steps can be executed automatically by the processor, it is possible for the processor to execute these steps in response to control commands issued by the host device. Thus, more flexible operations by the system including both the processor and host device are made possible.

If, on the other hand, the inserted check S is determined to be valid, then, as indicated by step S8, the first feed rollers 27, 28 are rotated to feed the check S in the forward direction in preparation of a succeeding print process. The check S is delivered from the first feed rollers 27, 28 to the second feed rollers 29, 30. With the roller 30 moved to the position shown by the dotted line in FIG. 3, movement of the check S is stopped temporarily when the leading edge of the check S reaches the second feed rollers 29, 30. The feed roller 30 is then moved to the position shown by the solid line in FIG. 3 to hold the check S with the second feed rollers 29, 30. The second feed rollers 29, 30 are rotated to feed the check S in the forward direction. Note that the movement of the check S is not necessarily stopped if the mechanism for opening and closing the first and second feed rollers can operate quickly.

In step S9, the second print part 23 is driven to print an endorsement on the back surface of the checkS. At substantially the same time or in parallel, the first print part 4 is driven to print the front surface inscription on the front surface of the check S. These print processes can be executed in accordance with print data and control commands received from the host device. In this case, feeding direction of the check S is determined based on the print data and the control commands. Next, in step S10, the check S is fed further in the forward direction to discharge it from the opening 21. This process can be done in response to a predetermined control command received from the host device.

The first and second print parts 4, 23 are used respectively to execute the front surface inscription and back surface endorsement printing operations on the two opposite surfaces of the check S. In particular, after reading the MICR characters, the front surface inscription printing operation and the back surface endorsement printing operation are performed simultaneously or in parallel while feeding the check S in the forward direction. Therefore, simply by loading the check S into the composite processor 1 and operating the composite processor once, all necessary operations can be executed. The processing time can be reduced and, because it is not necessary to turn over the check S, the entire operation is simplified. Additionally, since the check S can be loaded so that the surface with the MICR characters recorded thereon faces up, the operator can set the check S while observing the front surface. That facilitates mounting of the check S in the apparatus.

Furthermore, by rotating the roll paper feed mechanism 3, an inking member such as the ribbon cassette of the second print part 23 can be replaced easily. In addition, since the second print part 23 includes a print unit which can be mounted onto and removed from the processor main body, the processor 1 provides greater versatility and permits a user to select the print unit to be used. Moreover, by incorporating an impact shuttle-type print head in the second print part 23, the second print part can be made thin and compact, thereby making the entire processor more compact.

In some implementations, the first feed rollers 27, 28 are disposed upstream of the magnetic head 33. When the check S is drawn out from the magnetic head 33, the feed speed of the check S as it passes the magnetic head 33 can be stabilized even if the check S is thin and not very rigid. The reading precision of the magnetic head 33 can, thus, be enhanced.

Figure 5:
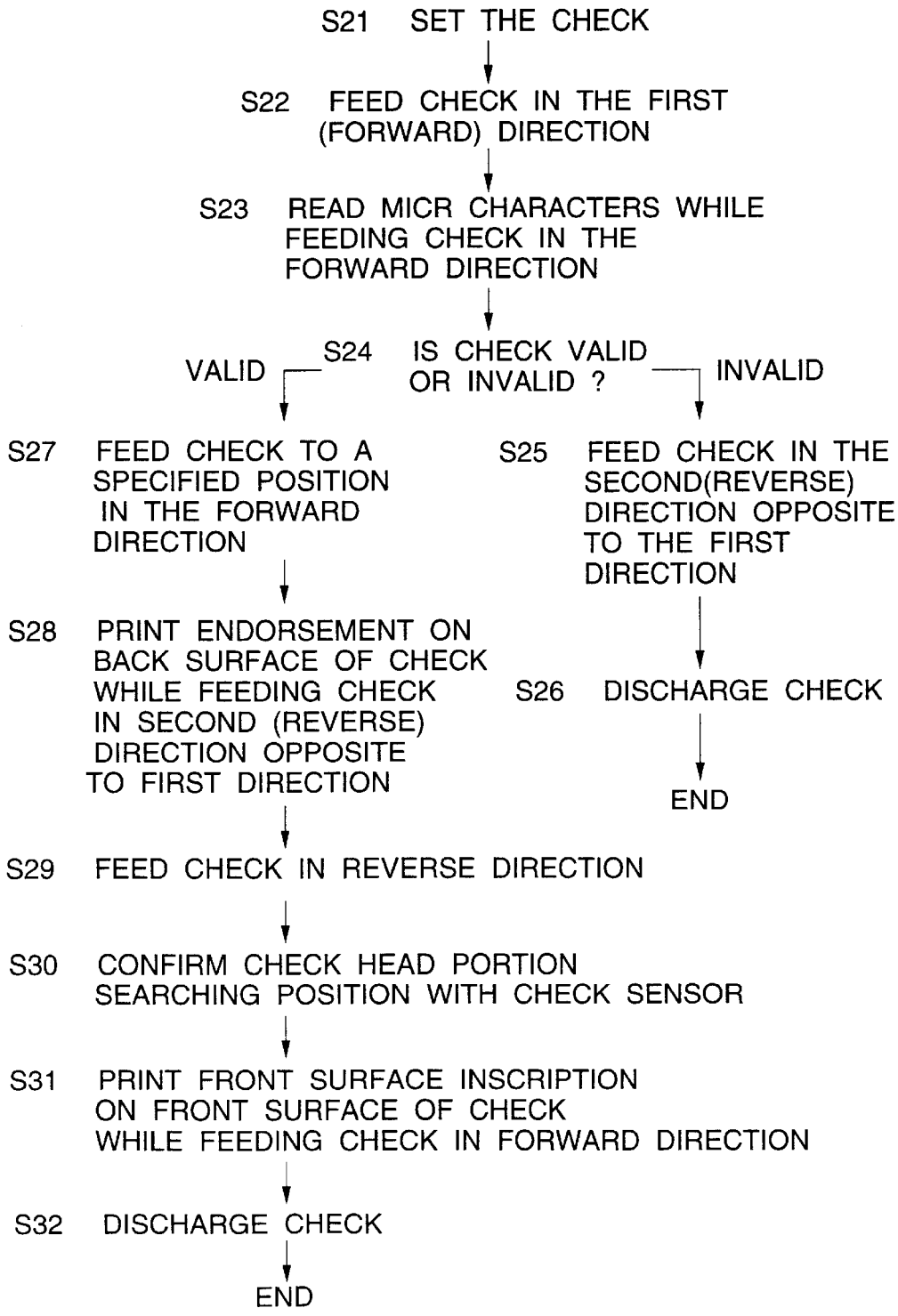
FIG 5. is a flow chart of a method of controlling a composite processor according to a second embodiment of the invention.

Referring to FIG. 5, the operation of the composite processor 1 is described according to a second embodiment. As indicated, respectively, by steps S21 and S22, the processor waits the check S to be set, and the check S is held as previously explained with respect to steps S1 and S2. The check S may be fed so that the leading edge of the MICR character string is positioned at the detecting portion of the magnetic head 33 if necessary. In step S23, the MICR characters on the front surface of the check S are read by the magnetic head 33 while feeding the check paper S in the forward direction. It is desirable that the second feed rollers 29, 30 are in the open state before the MICR reading begins. Because, if the second feed rollers 29, 30 are in the closed state, the change in the check transfer speed caused when the check S abuts on the rollers may disturb the reading data acquisition to increase reading error rate.

Next, as indicated by step S24, a determination is made as to whether the check S is valid or invalid based on the data obtained from the MICR read head. If the check S is judged to be invalid, then the processing moves to step S25. If, on the other hand, the check S is judged to be valid, then the processing moves to step S27. As before, an inserted recording media may be determined to be invalid because it is inserted improperly, because a slip sheet other than a check S is inserted or because the check S itself is invalid.

Note that this judgment can be made by a host device to which the processor of this embodiment is connected. That is, the processor sends to the host device the MICR reading results such as character codes and status data of the processor, the host device judges whether the check S is valid or not based on the results received from the processor, and the processor then receives the judgment made by the host device. Thus more accurate judgment can be made by executing more complicated processes such as making an inquiry to a bank which issues the check S.

If the inserted check S is determined to be invalid, then, as indicated by step S25, the check S is fed in the reverse direction. The check S is discharged from the opening 26, as indicated by step S26. This process can be done in response to a predetermined control command received from the host device.

If, on the other hand, the check S is determined to be valid, then, as indicated by step S27, the check S is fed in the forward direction to a specified position where the second print part 23 can print a portion of the check S near its trailing edge. This process can be done in response to a predetermined control command received from the host device. In step S28, the second print part 23 prints an endorsement on the back surface of the check S while the check S is fed in the reverse direction. This print process can be executed in accordance with print data and control commands received from the host device. In this case, feeding direction of the check S is determined based on the print data and the control commands. After completion of the endorsement printing, the check S is then fed further in the reverse direction as indicated by step S29.

In Step S30, the trailing edge or the lower end portion of the check S is detected by the sensor 32 to confirm the head portion searching position of the check S. After the head portion of the check S is searched, then, as indicated by step S31, the first print part 4 prints the front surface inscription on the front surface of the check S while the check S travels in the forward direction. This print process can be executed in accordance with print data and control commands received from the host device. In this case, feeding direction of the check S is determined based on the print data and the control commands. The check S is fed further in the forward direction and is discharged from the opening 21. This process can be done in response to a predetermined control command received from the host device.

According to the second embodiment, all necessary operations can be executed simply by inserting a check S into the composite processor 1 and operating the composite processor a single time. Even when slip sheets or recording media of different sizes are to be processed, the front surface inscription and back surface endorsement can be printed accurately. Also, the peak current of the process can be reduced because the first and second print heads are configured so that they do not print at the same time. The reduced current makes it possible to reduce the cost and size of the power source of the composite processor 1 as well as other circuit elements. In some implementations, the first feed rollers 27, 28 are disposed downstream of the magnetic head 33. When the check S is drawn out from the magnetic head 33, the speed of the check S as it passes the magnetic head 33 can be stabilized even if the check S is thin and not very rigid. The reading precision of the magnetic head 33 can, thus, be enhanced.

Figure 7:
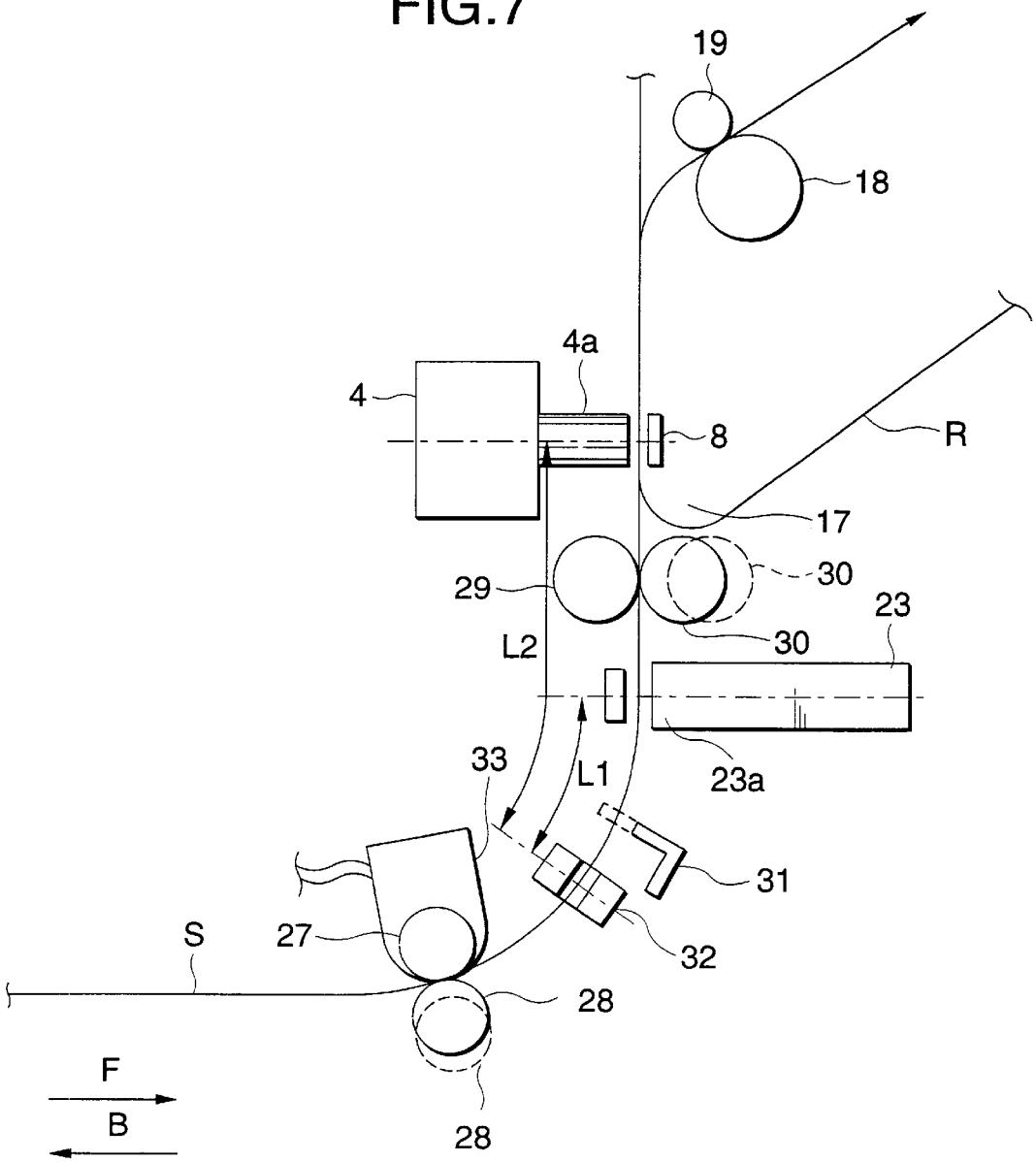
FIG. 7. is a schematic structure view of the main portions of a composite processor according to a third embodiment of the invention.

FIG. 7 is a schematic structure view of the main portions of a composite processor according to a third embodiment of the invention.

The structure shown in FIG. 7 is the same as the structure 5 shown in FIG. 3; however, in FIG. 7, first and second distances L1 and L2 are determined. The first distance L1 is a distance from the sensor 32 to a print head 23*a*, whereas the second distance L2 is a distance from the sensor 32 to a print head 4*a*.

FIG. 8 is a schematic view of a check S.

Figure 8B:
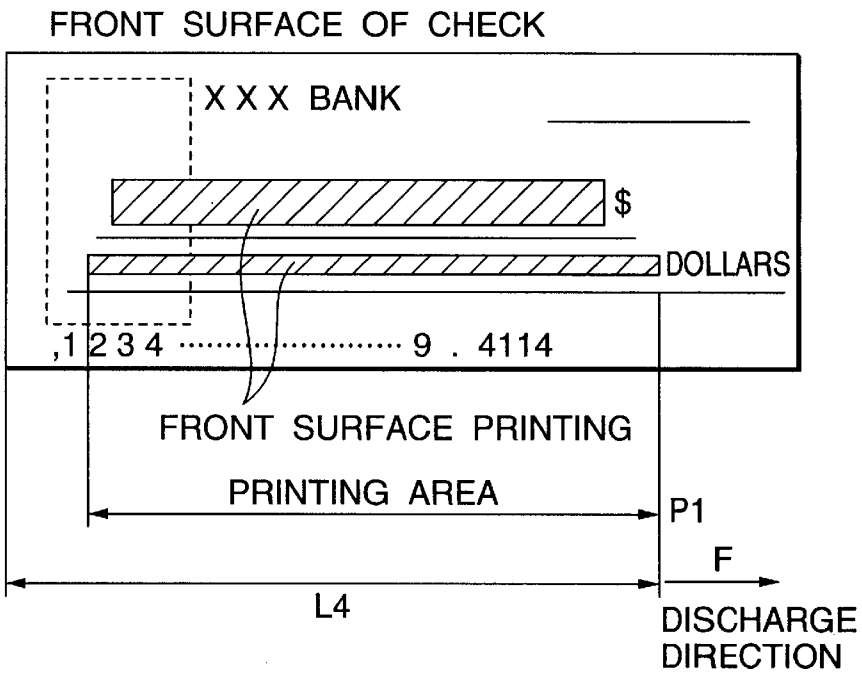
FIG. 8A is a schematic view of the back surface of a check and FIG. 8B its a schematic view of the front surface of the check.
Figure 8A:
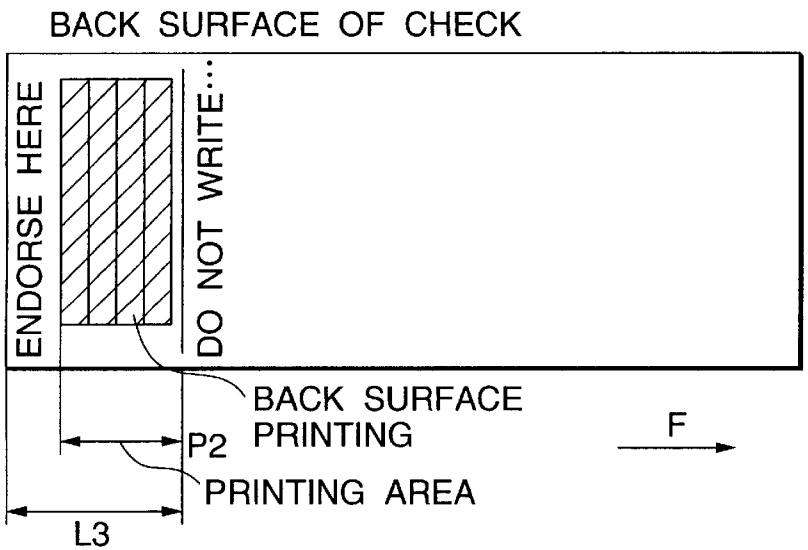

Specifically, FIG. 8A is a schematic view of the back surface of the check S, in which a distance from the end portion of the check S to a printing area is determined as a third distance L3. Also, a position distant by the third distance L3 from the end portion of the check S is determined as a second printing start position P2. In the case of the printing of the back surface endorsement, after feeding the check S in the F direction firstly, the back surface endorsement printing starts at the second printing start position P2 and is done in the printing area of the back surface of the check S.

FIG. 8B is a schematic view of the front surface of the check S, in which a distance from the end portion of the check S to a printing area is determined as a fourth distance L4. Also, a position distant by the fourth distance L4 from the end portion of the check S is determined as a first printing start position P1. In the case of the front surface inscription printing, after feeding the check S in the F direction firstly, the front surface inscription printing starts at the first printing start position P1 and is done in the printing area of the front surface of the check S.

Figure 9:
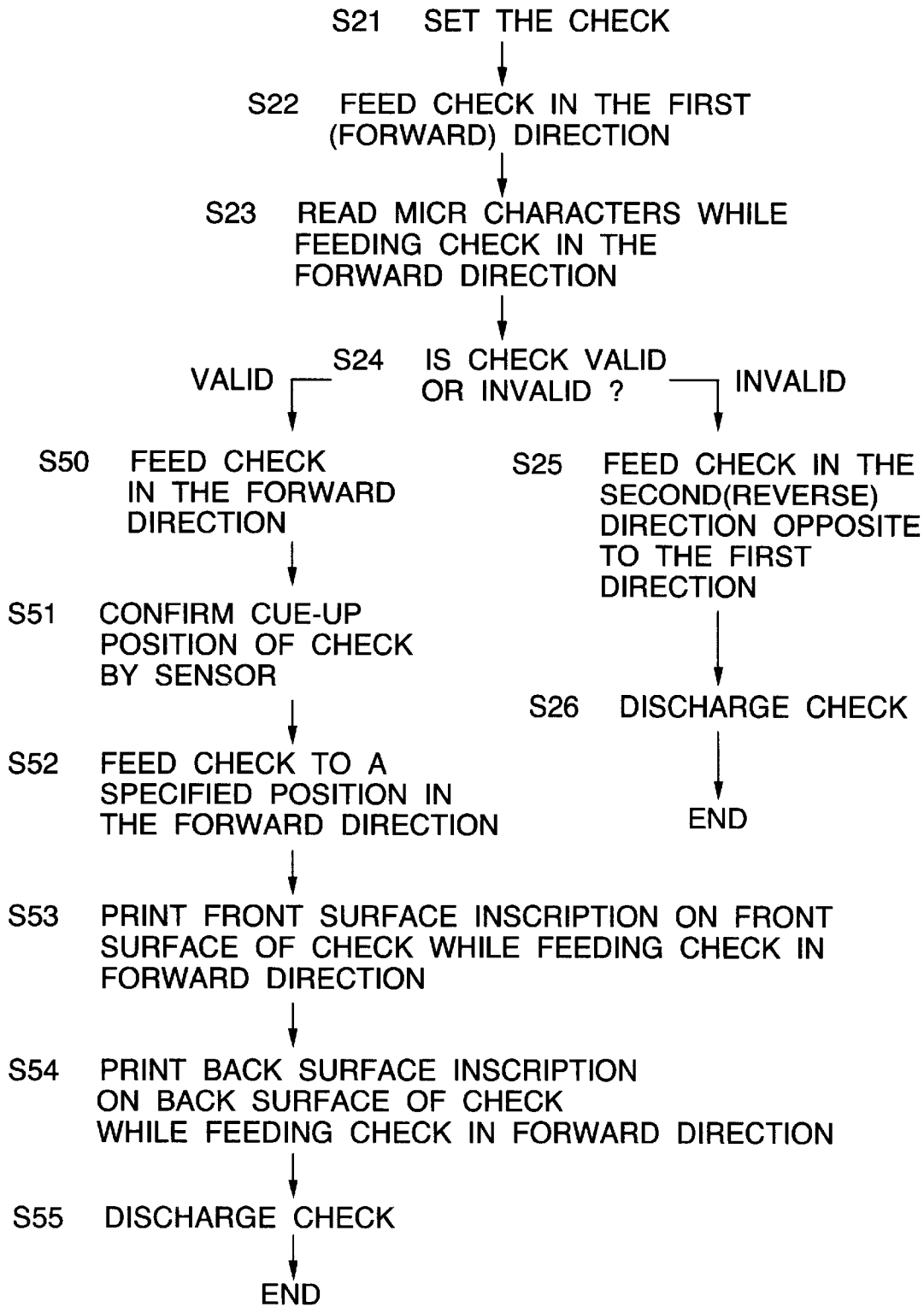
FIG. 9. is a flow chart of a third embodiment of a method for controlling a composite processor according to the invention.

Now, FIG. 9 is a flow chart of the third embodiment of a method for controlling a composite processor according to the invention.

Steps S21 to S26 are the same as in the second embodiment and, therefore, description will be given below of Steps S50 to S55.

In Step S50, in preparation for a printing process to be executed next, the check S is fed further in the forward direction. By the way, the present feeding processing can be executed in accordance with a predetermined command received from a host device.

In Step S51, the end portion of the check S is detected by the sensor 32 to thereby confirm the cue-up position of the check S.

In Step S52, the check S is fed on while calculating the feeding distance until a difference (L2–L4) between the second distance L2 (FIG. 7) and the previously set fourth distance L4 (FIG. 8B) of the front surface of the check S becomes zero, that is, while calculating the feeding distance until the first printing start position P1 (FIG. 8B) reaches the print head 4*a*. Here, to calculate the feeding distance, for example, using a stepping motor as a drive mechanism, the drive step number may be counted. By the way, the condition for execution of this feeding operation is that the second distance L2 is larger than the fourth distance L4, that is, L2>L4. Also, the fourth distance L4 can be set in accordance with a predetermined command received from the host device.

In Step S53, while moving the check sheet S in the forward direction, the front surface inscription printing is done on the front surface by a first print part 4. By the way, this printing process can also be executed in accordance with printing data or other control commands received from the host device.

In Step S54, similarly to the front surface inscription printing that has been described above, the back surface endorsement printing is done. That is, the check S is fed on while calculating the feeding distance until a difference (L1–L3) between the first distance L1 (FIG. 7) and the previously set third distance L3 (FIG. 8A) of the back surface of the check S becomes zero, namely, while calculating the feeding distance until the second printing start position P2 (FIG. 8A) reaches the print head 23*a* (StepS52). By the way, the condition for execution of this feeding operation is that the first distance L1 is larger than the third distance L3, that is, L1>L3. Also, the third distance L3 can be set in accordance with a predetermined command received from the host device. After then, while moving the check S in the forward direction, the back surface endorsement printing is done on the back surface of the check S using the second printing part 23. By the way, this printing process can also be executed in accordance with printing data or other control commands received from the host device.

In Step S55, the check S is fed further in the forward direction to thereby discharge it from the opening 20*a*. By the way, the present feeding processing can also be executed in accordance with a predetermined command received from a host device.

According to the present embodiment, in case where the check S is once loaded into the composite processor and the composite processor is then operated, all necessary processings can be executed and, in addition to this, the printing can be done while feeding the check sheet S only in the forward direction, thereby being able to reduce the printing process time greatly.

As previously noted, the first and second print parts 4, 23, can execute their respective printing operations using ribbon cassette-type printers. Alternatively, the printing operations can be performed using ink jet printers or the like to reduce the printing sound of the print head and to obviate the need to provide a large gap between the print head and the platen 8. In yet other implementations, a thermal printer, in which ink is fused from a ribbon and transferred to the recording media, can be used. An ink ribbon which is capable of printing two or more times also can be used. In some implementations, only the second print part 23 includes an ink jet-type printer or a thermal transfer-type printer. Use of such printers is advantageous because the number of printed lines for the endorsement on the back surface of the check is small, and the second print part is not required to print a large number of sheets. In addition, such printers provide better print quality than an impact type printer.

Although the foregoing embodiments have been described with respect to a recording medium such as a check S, other types of recording media also can be used, provided that printing can be performed on both surfaces of the recording media. For example, the paper or sheet material can be formed in a roll shape, or it may include a film-shaped sheet formed of printable resin. When a recording medium including resin is used, an ink jet-type print head can be used as the first and second print heads.

As disclosed in the foregoing description, a pressure roller is used to bring the check S into close contact with the magnetic head 33. However, other non-rotating member can be used as well. To reduce the feed load, the member for bringing the check S into contact with the magnetic head 33 should provide a small friction coefficient with respect to the check S.

In the processor of the present embodiment, the roll paper feed mechanism 3 is disposed so that it can rotate about pivot 12 and supplies the roll paper R to the first print head 4*a* for printing when the roll paper feed mechanism 3 is positioned as shown by the solid line in FIG. 1. However, the present invention is not limited to this configuration. The roll paper feed mechanism 3 can be further provided with a third print head dedicated on printing the roll paper R fed in the mechanism 3. Preferably the third print head is a thermal line print head explained in detail in the U.S. Pat. application Ser. No. 08/752,782 which is incorporated herein by reference.

Other implementations are within the scope of the following claims.

What is claimed is:

1. A method for processing a recording medium with embedded information, said method comprising the steps of:

feeding said recording medium along a passage in a first direction toward a discharge opening;

reading magnetic information recorded on said recording medium while moving said recording medium along said passage;

after completion of said reading step, printing information on a first surface of said recording medium while moving said recording medium along said passage; and after completion of said reading step, printing information on a second surface of said recording medium opposed to said first surface while moving said recording medium along said passage;

wherein the feeding direction of said recording medium in said reading step is said first direction, the feeding directions of said recording medium in said first and second printing steps are respectively said first direction, and said information printings on said first and second surfaces are done substantially simultaneously or concurrently.

2. A method according to claim 1, wherein the steps of printing information on the first surface of said recording medium and on the second surface of said recording medium are performed by first and second printing mechanisms, respectively, disposed on opposite sides of said passage.

3. A method according to claim 1, wherein the step of feeding said recording medium comprises inserting said recording medium into an insertion opening positioned spaced from said discharge opening.

4. A method according to claim 3, further comprising limiting an initial insertion amount of said recording medium into said insertion opening.

5. A method according to claim 3, further comprising detecting a presence of said recording medium in said insertion opening.

6. A method comprising the steps of:

positioning a first printing mechanism on a first side of a passage;

positioning a second printing mechanism on a second side and downstream of said passage;

feeding a recording medium along said passage in a downstream direction toward a discharge opening;

reading magnetic information recorded on said recording medium while moving said recording medium along said passage;

printing information on a first surface of said recording medium with said first printing mechanism while moving said recording medium in said downstream direction along said passage; and printing information on a second surface of said recording medium opposed to said first surface with said second printing mechanism while moving said recording medium in said downstream direction along said passage, wherein said printing steps on said first and second surfaces are done substantially simultaneously or concurrently.

7. A method according to claim 6, wherein the step of feeding said recording medium along a passage comprises inserting said recording medium into an insertion opening positioned spaced from said discharge opening.

8. A method according to claim 7, further comprising limiting an initial insertion amount of said recording medium into said insertion opening.

9. A method according to claim 7, further comprising detecting a presence of said recording medium in said insertion opening.

* * * * *